US005227022A

United States Patent [19]

Leonhardt et al.

[11] Patent Number: 5,227,022

[45] Date of Patent: Jul. 13, 1993

[54] PROCESS FOR INCREASING PULP BRIGHTNESS WITH ZEOLITES AND EASILY DECOMPOSABLE ORGANIC CHELATING AGENTS

[75] Inventors: Wolfgang Leonhardt, Frankfurt; Kurt Schmidt, Hammersbach; Hans U. Suess, Gondsroth; Holger Glaum, Kahl, all of Fed. Rep. of Germany

[73] Assignee: Degussa Aktiengesellschaft, Frankfurt am Main, Fed. Rep. of Germany

[21] Appl. No.: 885,688

[22] Filed: May 19, 1992

[30] Foreign Application Priority Data

Jun. 8, 1991 [DE] Fed. Rep. of Germany ..... 4118899

[51] Int. Cl.[5] ..... D21C 9/10

[52] U.S. Cl. ..... 162/76; 162/79; 162/80

[58] Field of Search ..... 162/79, 76, 80, 78, 162/83

[56] References Cited

U.S. PATENT DOCUMENTS 4,238,282 12/1980 Hyde ..... 162/80

5,039,377 8/1991 Von Raven et al. ..... 162/78

*Primary Examiner*—W. Gary Jones

*Assistant Examiner*—Dean Tan Nguyen

*Attorney, Agent, or Firm*—Beveridge, DeGrandi, Weilacher & Young

[57] ABSTRACT

A process is disclosed for bleaching wood pulp, cellulose or used paper by treatment the fibre material to be bleached before the bleaching steps with a natural or synthetic zeolite or a layer lattice silicate and an easily decomposable organic complex forming agent, e.g. citric acid.

4 Claims, No Drawings

PROCESS FOR INCREASING PULP BRIGHTNESS WITH ZEOLITES AND EASILY DECOMPOSABLE ORGANIC CHELATING AGENTS

INTRODUCTION AND BACKGROUND

The present invention relates to a process for bleaching a fibrous raw material such as wood pulp, cellulose, used paper and/or a mixture thereof using hydrogen peroxide or dithionite.

Heavy metals and salts thereof catalyze the decomposition of chemical bleaching agents (e.g. hydrogen peroxide or dithionite). In order to minimize the losses of the bleaching agent and to enable the carrying out of the bleaching process in a batch having a high heavy metal content, chelate forming agents are added in actual practice.

In principle all chelate forming agents can be used which form a complex of suitable stability and which are not attacked by the bleaching agent in the course of the bleaching process. Generally organic compounds are used. In the paper and textile industry particularly, salts of nitrilo-tri-acetic acid (NTA), ethylene diamine tetraacetic acid (EDTA) and diethylene triamine pentaacetic acid (DTPA) are used due to the excellent stability of the complexes formed thereby. Ions of the metals iron, cobalt and manganese, which exhibit a particularly unfavorable effect during the bleaching process by causing catalytic decomposition, are particularly efficiently bound by the polyvalent DTPA.

Weaker chelate forming agents, such as citric acid, tartaric acid, saccharic acids, polymeric acrylic acid derivatives or lower polyoxycarboxylic acids, do not form generally complexes of higher stability. In order to protect bleaching agents from decomposition induced by heavy metals, said agents are added in extremely high amounts. For this reason the use of said bleaching agents according to the state of prior art is not economically acceptable, although these bleaching agents are practically quantitatively decomposed by aerobic or anaerobic procedures in conventional sewage purifying equipment.

The disadvantage in using the above-mentioned EDTA and DTPA as well as also the phosphonic acid thereof (e.g. diethylene-triamine-pentamethylene phosphenate), resides in the fact that these compounds can be decomposed by biological means only in a very difficult and circumstantial manner. Basically an accumulation of the precipitated heavy metals in the environment and the risk of subsequent release thereof (e.g. from sediments in running waters) can not be avoided.

In German Application No. 37 39 655 an alkaline peroxide-containing bleaching agent is disclosed which comprises a silicate-type ion-exchanger modified with an alkali carbonate or alkali hydrogen carbonate additive. This process in said to constitute a solution of the problem, namely providing a bleaching process without requiring addition of alkali hydroxide or, at most, the addition thereof in only a small amount; and without the addition of water glass or, at most, the addition thereof only in small amount; and without bleaching addition of a complex forming agent, or the addition thereof only in a small amount.

SUMMARY OF THE INVENTION

In contrast to the prior art, it is an object of the present invention to provide a bleaching process which can be economically carried out by using easily decomposable complex forming agents and which gives good bleaching results.

In attaining the above and other objects, the present invention provides a process for the bleaching of a fibrous raw material such as those selected from the group consisting of wood pulp, cellulose, used paper and mixtures thereof using hydrogen peroxide or dithionite, in the presence of a chelate forming agent, wherein the fibrous raw materials to be bleached are subjected to a pre-treatment before the bleaching step, at a consistency of from 1.5 to 25%, with a natural or synthetic zeolite or a layer lattice silicate.

It is evident that the above materials; i.e. the zeolite and the silicate must be capable of acting as cation exchangers in the process.

DETAILED DESCRIPTION OF INVENTION

The pre-treatment process is carried out in a manner known per se and is performed generally at conditions that range from weakly acidic to weakly alkaline pH range, particularly at a pH value from 6 to 8 at a consistency of from 1.5% to 25%, particularly from 2% to 10% (atro) at a temperature of from 20° C. to 100° C., particularly in the range of 50°–80° C. The term "atro" means on a dry basis.

Bleaching with peroxide in the known manner can be followed by further conventional washing and bleaching steps carried out under various conditions as will be apparent to those skilled in the art.

The above disclosed pH and temperature values generally relate to the pre-treatment step as well.

The heavy metal content of a bleaching liquor is generally very low in the aqueous phase. This can be attributed in the first place to the fact that heavy metals are soluble only to a very small extent in alkaline medium. The major part of the heavy metals is bound in the wood pulp fibre as a complex. Iron ions are fixed, for example, by the phenolic groups of lignin.

It is essential that the zeolites and/or layer silicates suitable as cation exchangers shall have a greater complex forming constant towards heavy metals than lignin.

The formula of the zeolite component is generally $$(Na_2O)_x \cdot (Al_2O_3)_y (SiO_2)_z \cdot w\ H_2O$$

wherein $x=1$;

$y=0.8$–$1.2$ preferably about 1;

$z=1.5$–$3.5$, preferably 2–3 or about 2 and $w=0$–$8$, preferably 2.5–6.

Such zeolites are cation exchangers and the calcium ion exchange capacity thereof is between about 200 and 400, or even more, mg equivalent calcium carbonate hardness per g. These substances are preferably hydrated, up to 5–30%, particularly up to a moisture content of 10–25%, e.g. and 20%. Zeolite A proved to be preferable but zeolites X, Y and P are also suitable for this purpose. It is particularly preferable to use zeolite 4A. The particle size of the zeolite or zeolites is generally from 0.194 to 0.037 mm which corresponds to 100–400 mesh, preferably 0.105, or from 0.074 to 0.044 mm corresponding to 140 or from 200 to 325 mesh. The extreme outer limits may fall, however, in to the range of submicrons.

The particle size falls preferably within an interval which is almost by one order of magnitude smaller than that of the cellulose fibers to be bleached. All suitable zeolites as described above are well known in the art.

The silicate type ion exchangers suitable for purposes of this invention are well known in the art and are not subjected to a pre-treatment with a carbonate before the use thereof. It is introduced in an amount of from 0.5 to 2.5% by weight, particularly from 1.5% by weight, related to the fibre material (atro). The layer lattice silicates are well known in the art.

The experimental results show that the pre-treatment according to the present invention leads to better bleaching results than do the conventional bleaching methods where DTPA and hydrogen peroxide are simultaneously used.

However, if in this step the silicate-type ion exchanger is combined with a biologically decomposable complex forming agent, significantly improved bleaching results are obtained.

It has been found to be particularly advantageous to use organic compounds capable of forming a biological complex; e.g. citric acid, tartaric acid, maleic acids, saccharic acids, heptagluconate lower acrylates or generally known lower polycarboxylic acids. These substances can be used either per se or in the form of a mixture thereof or as a salt.

The above organic compounds can be added in an amount of 0.1–2% by weight, preferably up to 1% by weight, related to the fibre material (atro). In the place of the acids the corresponding salts can also be used.

A pre-condition of the suitability of these organic complex forming agents is that the complex forming constant thereof with heavy metals should be lower than that of the silicate-type ion exchanger used.

The pre-treatment of the pulp is generally carried out for a period of time between 15 minutes and 24 hours. Conventional mixing tanks can be used to mix the fibrous pulp with the zeolites/silicate according to the invention.

The following examples illustrate the present invention, especially the advantages thereof.

In all experiments constant limiting conditions and identical raw material were used (spruce-TMP with a whiteness grade of 54.2% ISO).

| | |
|---|---|
| Bleaching conditions: | 70° C., dwell time 3 hours; consistency 20%, 2% $H_2O_2$, 1.3% NaOH, always related to the cellulose atro (as in all the examples). pH start 10.6 pH end 8.2 |

EXAMPLE 1

Conventional bleaching without any pre-treatment of the raw material.

The above chemical agents and 0.3% of DTPA were added to the bleach. Thus a bleached wood pulp having a whiteness of 65.3 at a residual peroxide content of 0.14% was obtained.

EXAMPLE 2

Pretreatment with Zeolite

Cellulose (consistency 20%) was treated with 1% of zeolite of type A at a temperature of 70° C. and a pH value of 7.2. The Subsequent bleaching was carried out without the addition of further additives. The whiteness of the wood pulp amounted to 66.8 at a residual peroxide content of 0.24%.

EXAMPLE 3

Pre-treatment with Zeolite and Citrate

Wood pulp was treated with 1% of zeolite A and 0.2% of sodium citrate at a pH value of 7.2 under the conditions disclosed in example 2. The subsequent bleaching steps provided a wood pulp having a whiteness of 70.1 at a residual $H_2O_2$ content of 0.88%.

These examples show that pre-treatment with zeolite can be significantly improved by addition of a weak complex forming agent.

EXAMPLE 4

Wood pulp was treated only with 0.5% sodium citrate under the conditions described in Example 2. The bleached product had a whiteness of 64.8% ISO at a residual $H_2O_2$ content of 0.11%.

EXAMPLE 5

Pre-treatment with Citrate

The process was carried out under the conditions described in Example 4 by adding 1.0% of sodium citrate. The whiteness of the fibre material amounted to 64.8% ISO at a residual $H_2O_2$ content of 0.21.

Further modifications and variations will be apparent to those skilled in the art and are intended to be encompassed by the claims appended hereto.

German priority document P 41 18 899.3 is relied on and incorporated herein by reference.

We claim:

1. A process for increasing pulp brightness of a bleached raw material selected from the group consisting of wood pulp, cellulose, used paper and mixtures thereof comprising pretreating said raw material at a consistency of from 1.5% to 25% prior to bleaching with a natural or synthetic zeolite or a layer lattice silicate and simultaneously with an easily decomposable organic chelate forming agent; wherein the complex forming constant of said natural or synthetic zeolite or said layer lattice silicate with heavy metal ions is larger than that of lignin in said raw material and the complex building constant of said easily decomposable organic chelate forming agent is lower than that of said zeolite or said layer lattice silicate and wherein said pretreating step results in an improved pulp brightness.

2. The process according to claim 1, further comprising adding from 0.1 to 2.0% of a member of the group consisting of citric acid, tartaric acid, saccharic acids, maleic acid, and salts of said acids, heptagluconate, lower acrylates, lower polycarbonic acids, and mixtures thereof.

3. The process according to claim 1, wherein from 0.5 to 2.5% by weight of zeolite of type A is used.

4. The process according to claim 1, wherein from 0.5 to 2.5% by weight of a zeolite of type X, Y, or P is used.

* * * * *